US005263646A

United States Patent [19]

McCauley

[11] Patent Number: 5,263,646

[45] Date of Patent: Nov. 23, 1993

[54] HIGH-PRESSURE PAINT SPRAYER WAND

[76] Inventor: Patrick J. McCauley, 1369 Bonair Rd., Vista, Calif. 92083

[21] Appl. No.: 959,793

[22] Filed: Oct. 13, 1992

[51] Int. Cl.[5] ..... B05B 1/00; B05B 9/01

[52] U.S. Cl. ..... 239/154; 239/526; 239/588; 138/DIG. 8

[58] Field of Search ..... 239/588, 154, 526, 531, 239/532; 138/DIG. 8; 285/133.1

[56] References Cited

U.S. PATENT DOCUMENTS

| | | | |
|---|---|---|---|
| 2,061,987 | 11/1936 | Sorensen | 239/588 |
| 2,203,210 | 6/1940 | Young | 239/588 |
| 2,577,437 | 12/1951 | Stringer | 239/526 |
| 2,971,520 | 2/1961 | Motis et al. | 239/588 |
| 3,929,164 | 12/1975 | Richter | 138/DIG. 8 |
| 4,669,508 | 6/1987 | Neaves | 138/DIG. 8 |
| 4,669,757 | 6/1987 | Bartholomew | 138/DIG. 8 |
| 4,683,917 | 8/1987 | Bartholomew | 138/DIG. 8 |
| 4,895,280 | 1/1990 | Tourigny | 239/588 |

FOREIGN PATENT DOCUMENTS

| | | | |
|---|---|---|---|
| 3606018 | 6/1987 | Fed. Rep. of Germany | 239/588 |

*Primary Examiner*—Andres Kashnikow
*Assistant Examiner*—Lesley D. Morris
*Attorney, Agent, or Firm*—Ralph S. Branscomb

[57] ABSTRACT

A wand is used to attach to the output of a high-pressure spray gun, with the nozzle or sprayer connected to the other end of the wand. The wand has the characteristics of containing the high-pressure delivered by the spray gun at about 3000 PSI in an internal high-pressure, highly flexible line, which is captured within an external, bendable sheath which retains the shape into which it is bent, so that paint may be more conveniently sprayed in corners and out-of-the-way places.

1 Claim, 1 Drawing Sheet

HIGH-PRESSURE PAINT SPRAYER WAND

BACKGROUND OF THE INVENTION

The invention is in the field of painting, and in particular addresses high-pressure spray equipment that delivers airless sprayed paint under a pressure of 3000 pounds per square inch or more.

Sprayers of this type are trigger-operated somewhat similar to a typical gasoline pump, and for up-close work are used with no extensions or other attachments, being connected to the high-pressure paint delivery system through a flexible high-pressure hose.

When the painter is painting a ceiling or another structure in which it would be much more convenient to extend the spray head a distance away from the spray gun, typically a rigid wand is used. Such a wand is used when spraying in the corners of the ceiling and the walls of a room, as well as the portion of the walls.

If only a rigid wand is used, the painter is required to assume a strained and awkward position to operate the spray gun and deliver the spray to the ceiling. The gun is designed for more typical horizontal spraying operations, and it creates a problem for the painter to use it vertically.

Additionally, obviously a rigid wand will not always be able to delivery the paint spray evenly to an area that is hard to reach. For example, the corners between walls and ceilings of a room will receive the paint sprayed at an angle to both surfaces near their juncture suing a rigid rod extension.

To address this problem, spray gun extensions have been developed and marketed such as one represented in U.S. Pat. No. 3,915,382. This type of extension has a knuckle joint at the top which mounts the spray head, and may be adjusted and tightened to a particular angle to address a particular surface. This enables the painter to adjust the spray direction from parallel to the spray wand, to orthogonal to it, or even down toward the painter for covering the tops of surfaces.

However, jointed extensions of this type, although easing the burden on the painter considerably, are time consuming to adjust in that typically a wing nut must be loosened to disengage two radially striated interfaces to permit rotation of the spray head to a different angle. For a professional painter, adjusting this knuckle joint continuously all day long can become a real nuisance.

There is a need for a paint spray wand which is bendable with no memory so that it will retain the shape into which it is re-bent. This would permit one-handed adjustment by the painter, which could be done in seconds, and which could also orient the spray head in any rotational direction around the spray gun so that the spray gun itself could be held in the same orientation if desired.

Form-retaining conduits have been around for a long time and are put to many uses. They are commonly used in plumbing under sinks and toilets to connect water lines, and are also used in gas lines for appliances.

Sheathing of this type however is not meant to be repeatedly bent, as after several bends they will break. For example, U.S. Pat. No. 4,966,202 issued Oct. 30, 1990 discloses a bendable unit that will retain its shape, and confine a certain amount of pressure, but is not designed for very high pressures, and is not designed to be repeatedly bent.

What the painter needs is a paint spray wand having the combined characteristics of very high-pressure delivery capabilities, being as light weight as possible, and having a form-retaining length or lengths, with or without a rigid wand extension, which will hold the spray head very firmly in a desired position until the sheath length is re-bent.

SUMMARY OF THE INVENTION

The instant invention fulfills the above stated need by providing a high-paint sprayer wand having at least one flexible, bendable link which is as lightweight as can be in keeping with the necessity of holding the spray head firmly in a desired orientation against the straightening forces applied by the high-pressure paint delivered through the sheath.

A high-pressure, bendable sheath could be used, but sheaths of this type capable of being bent to any desired orientation repeatedly and withstanding the internal pressure of over 3000 pounds per square inch, if they exist at all, would be very heavy and very expensive.

For this reason, the instant invention discloses a high-pressure wand in which the flexible link includes both a flexible internal high-pressure hose capable of a standing over 3000 pounds per square inch as is required of the paint spray system, and which is contained in a flexible sheath which is light-weight, and incapable of a standing high pressures but will withstand repeated bending without breaking and is light-weight and inexpensive.

This link, when used in the paint spray wand can comprise the entire wand, or be used in conjunction with a rigid type link, either at the spray head end, or the spray gun end, or both.

DETAILED DESCRIPTION OF THE PREFERRED EMBODIMENTS

Figure 1:
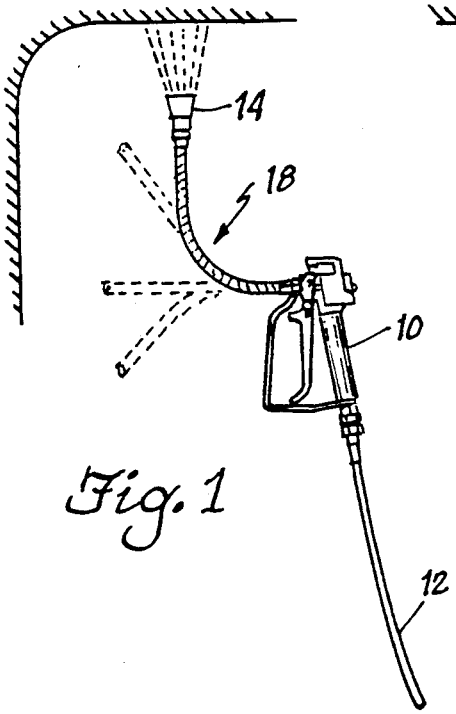
FIG. 1 is a side elevation view of the invention in use illustrating a single bendable link used as the spray wand between the spray gun and the spray head.

The basic high-pressure spray gun is illustrated at 10, being connected with a high-pressure hose 12 which is connected to a source of pressurized paint, not shown. The system is generally configured for an airless paint spray system.

The spray gun has a male fitting which directly connects to the spray head 14 for up-close operation. For more distant applications, a rigid, high-pressure metal pipe 16 can be used. Obviously, the pipe does not change the direction of the spray head. As mentioned in the background however, there is a system with a knuckle joint which can rotate the spray head about a single axis.

According to the instant invention, a bendable link 18 is provided with the same couplings, as the pipe 16, so that one end can be connected to the spray gun and the other ends to a rigid pipe length another bendable link, or the spray head directly.

The bendable link 18 comprises an internal high-pressure flexible line 20 having a spray gun coupling 22 at one end and a spray head coupling 24 at the other end, with both couplings being connected to the actual flexible tube of the line hose by ferrules 28. This tube, although fairly flexible, will withstand the 3000 per square inch and higher pressures required for delivering airless spray paint.

Figure 4:
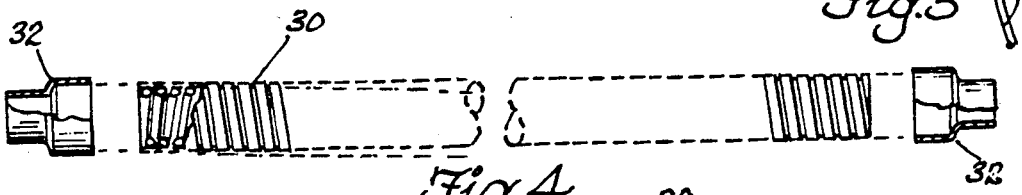
FIG. 4 is a partially broken away, partially in section side elevation view of a complete bendable link.
Figure 5:
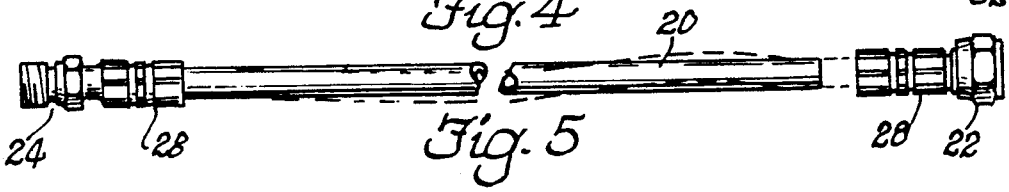
FIG. 5 is a side elevation view, partially broken away, of the internal high-pressure line with its end couplings; and, FIG. 6 is a side elevation view with parts cut away illustrating the complete bendable link and the manner in which the external sheath is crimped onto the ferrules of the line couplings.
Figure 6:
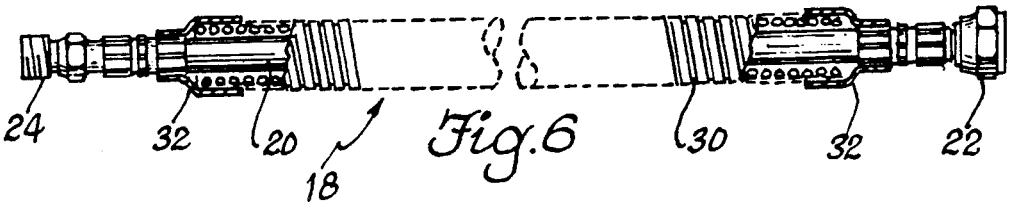

Enclosing the flexible line 20 is an external sheath 30 best seen in FIGS. 4 and 6, comprising the helically constructed bendable metal conduit that is on the market. This sheath is couple to the internal high-pressure line by means of the conduit ferrules 32 which are crimped or clinched down around the ferrules 28 of the high-pressure line. Clearly, there are alternative methods of connecting the ends of the Sheath to the internal line, but his method is easily done from a manufacturing point of view and is fairly durable.

The conduit of the sheath 30 need be both light-weight and fairly resistant to bending in order to be effective. Because it is not required to withstand internal pressure, this combination is possible. Were the conduit very heavy, professional painters simply would not use it, and were it very easily bendable, the straightening action of the pressure inside the high-pressured line and the reaction from the spray head would cause the link to bend against the wishes of the sprayer.

For this reason, it is the combination of the fairly flexible but very high-pressure internal hose, in the light-weight but relatively hard-to-bend conduit that makes the system practical.

Figure 2:
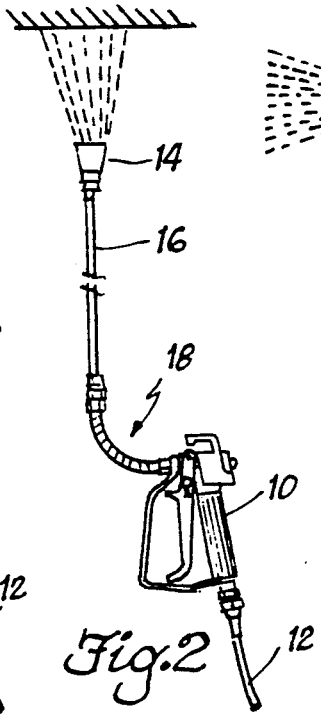
FIG. 2 illustrates a modification of the wand in which a rigid pipe length is interposed between the flexible link and the spray head.
Figure 3:
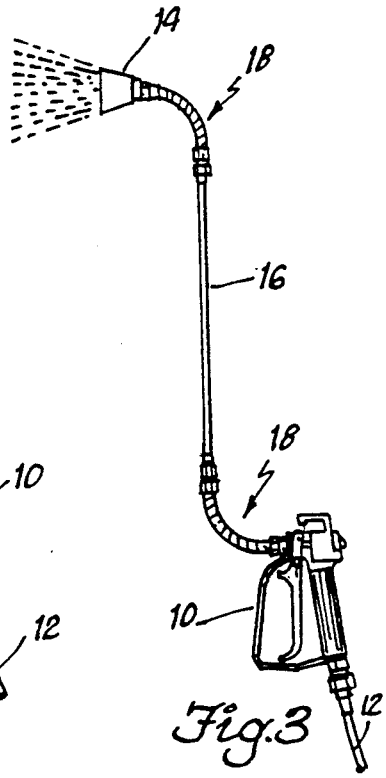
Fig. 3 is yet another embodiment of the invention in which a rigid high-pressure pipe length is utilized between two flexible links.

Using the pivotal extension that is now on the market, the painter must hold the spray gun so that it is directing the spray upwardly when the painter is spraying the ceiling. However, by using the configuration of FIG. 2 (or FIGS. 1 or 3, for that matter), the painter can hold the gun as though he were spraying straight ahead, and yet direct the paint spray upwardly to the ceiling, or wherever else he wants. Re-configuration is simply a matter of bending the bendable link, or both bendable links if the configuration of FIG. 3 is used. The flexible line has no memory in that once bent to a new configuration it stays that way having "forgotten" its prior shape. A fourth configuration similar to FIG. 2 but reversing the positions of the bendable link 18 and the pipes so that the flexible link is adjacent the spray head clearly would also be a possibility.

In order to hold the spray head in the proper orientation without it bending on its own, the conduit of the sheath 30 should be able to withstand a bending force of about 3 pounds at a one foot interval without bending. As mentioned above, there is great flexibility in the design parameters of the conduit because it is not required to be even water proof, much less resistant to high internal pressure.

When faced with the option of using the several wand systems made possible by the instant invention compared to present jointed extension to airpipes, there is little doubt that a great many professional painters are going to choose the invention disclosed herein. Not only does it provide a major advantage in painting hard-to-reach surfaces and ceilings, but it is also basically fool proof. The high-pressure hose with its end connectors is flexible and is not going to fail by virtue of repeated bending. The external sheath will eventually lose its ability to retain its configuration against the forces of the pressurized paint. At this point, however, the bendable link is simply replaced. There is no rupturing and spattering or dripping of paint in the area, as the internal high-pressure hose will always maintain its integrity.

For these reasons, it is believed that in the very specific area of the trades that the invention addresses, it will provide significant assistance to painters who must deal with painting equipment all day long, day after day.

It is hereby claimed:

1. A high-pressure paint sprayer wand comprising:

(a) a flexible high-pressure line having a spray gun coupling at one end for coupling to a high-pressure spray gun and a nozzle coupling at the other end for coupling to a paint spray head;

(b) a generally cylindrical sheath having a larger internal diameter than the external diameter of said line and extending around at least a portion of the length of said high-pressure line;

(c) said sheath comprising a bendable shape-retaining conduit having substantially no memory such that it remains in a curved shape into which it is bent until it is rebent into a subsequent configuration; and, (d) said couplings comprising threaded fittings having rigid line ferrules engaging over the respective ends of said line, and said sheath having a sheath ferrule at each end which is crimped over the respective line ferrules to hold the respective ends of said conduit and line together.

* * * * *